US005573420A

United States Patent [19]

Grosswendt

[11] Patent Number: 5,573,420

[45] Date of Patent: Nov. 12, 1996

[54] ELECTRICAL CORD AND ELECTRICAL PLUG SECURER

[76] Inventor: Patrick J. Grosswendt, 28954 Crest Dr., Agoura, Calif. 91301

[21] Appl. No.: 360,996

[22] Filed: Dec. 20, 1994

[51] Int. Cl.[6] ..... H01R 13/62

[52] U.S. Cl. ..... 439/371; 439/369; 24/16 PB

[58] Field of Search ..... 439/371, 368 M, 439/369 M; 24/168 B

[56] References Cited

U.S. PATENT DOCUMENTS

| | | | |
|---|---|---|---|
| 2,461,427 | 2/1949 | Kneebone | 173/322 |
| 2,725,543 | 11/1955 | Tanner | 339/87 |
| 3,197,830 | 8/1965 | Hoadley | 24/16 PB |
| 3,475,716 | 10/1969 | Laig | 439/369 |
| 3,781,761 | 12/1973 | Harwood | 339/75 P |
| 3,999,828 | 12/1976 | Howell | 439/369 |
| 4,183,603 | 1/1980 | Donarummo | 339/75 P |
| 4,514,026 | 4/1985 | Herbert | 339/75 P |
| 4,752,054 | 6/1988 | Jonsson | 248/51 |
| 4,773,874 | 9/1988 | Kopeski, Jr. | 439/369 |
| 4,957,450 | 9/1990 | Pioszak | 439/369 |
| 5,104,335 | 4/1992 | Conley et al. | 439/371 |
| 5,179,044 | 1/1993 | Muromachi et al. | 439/369 |

*Primary Examiner*—Gary F. Paumen
*Assistant Examiner*—T. C. Patel
*Attorney, Agent, or Firm*—Denton L. Anderson; David A. Farah; Sheldon & Mak, Inc.

[57] ABSTRACT

A device for securing together a plurality of cords and for securing together a plurality of loops of one or more cords comprising a disk-shaped first connector with a central opening and an access notch, and a first strip attached to the first connector. The plurality of cords or cord loops can be secured by wrapping the securing device around the cords or loops and then inserting a portion of the first strip into the central opening via the access notch. A securing device suitable for securing together a first plug with a second plug comprising a first connector attached to a first strip, a second connector attached to both the first strip and a second strip and a third connector attached to the second strip. Each connector has a central opening and an access notch. The first and second plugs can be secured together by inserting the first cord into the first central opening via the first access notch, inserting the second cord into the second central opening via the second access notch, and inserting the first cord into the third central opening via the third access notch, thereby placing inward axial tension on the plugs securing them together.

24 Claims, 1 Drawing Sheet

ELECTRICAL CORD AND ELECTRICAL PLUG SECURER

BACKGROUND

This invention relates to devices for securing together a plurality of cords and for securing together a plurality of loops of one or more cords, and to devices for securing together male and female plugs of electrical cords to avoid unintentional separation.

Electrical equipment frequently needs to be operated at a distance from an electrical outlet that exceeds the length of the equipment's integral electrical cord. Electrical extension cords are used to increase the range of the integral electrical cord, typically by connecting the male plug of the integral cord to the female plug of the extension cord and by connecting the male plug of the extension cord to the electrical outlet. This arrangement is disadvantageous in that excessive outward axial tension on the integral electrical cord plug and the extension cord plug will tend to undesirably separate the plugs.

Also, after being used, an electrical cord or plurality of cords are frequently stored by placing the cords or the loops of one cord on top of each other to form a coil or bundle. This coil or bundle arrangement conserves storage space, allows the cord or cords to be conveniently hung from a support and makes the cord or cords easier to transport. In order to maintain the coil or bundle, it is advantageous to secure the cords or loops of a cord together such that the coil or bundle structure remains intact.

There are a variety of methods used to prevent accidental disengagement of a male plug from a female plug and for keeping a plurality of cords or the loops of a cord in a coil or bundle structure or in close proximity to each other. Such methods include taping the two plugs together as well as using devices specifically designed to prevent disengagement. Similarly, the cords or loops of a cord can be tied together with rope or taped together.

The use of tape on either plugs or cords often disadvantageously leaves adhesive residue on the plugs or cords and the tape is generally not reusable., In addition, both rope and tape can be time consuming to apply and vary in their effectiveness between applications. Further, devices designed to prevent accidental separation of two plugs generally do not also function to maintain a plurality of cords or loops of a cord in a coil or bundle.

Therefore, it would be advantageous to have a single device which could be used to secure a male and female plug together during use of electrical equipment thereby preventing accidental separation upon the application of outward axial tension, as well as being useful for joining a plurality of cords together or a plurality of loops of a single cord, such as for storage or transportation between uses. Ideally, such a device would be easy to apply, reusable, easy and inexpensive to produce, predictable in the strength of its application, and both nonconductive and water resistant to render it suitable for electrical uses and for uses around water.

SUMMARY

The present invention is directed to a device that satisfies these needs. The apparatus can be used for securing together a plurality of cords and for securing a plurality of loops of one or more cords. In addition, some embodiments of the device can be used for securing together the plugs of electrical cords.

In a preferred embodiment, the apparatus comprises a disc-shaped first connector disposed within a reference plane. The first connector is substantially inflexible and nonelastic, and has a central opening and an access notch. The access notch allows a member disposed perpendicular to the reference plane to be inserted into the central opening. The access notch includes a pair of opposing teeth disposed in close proximity within the reference plane. The first connector can further comprise two or more adjoined layers, one layer of which functions to impart substantial inflexibility and nonelasticity to the first connector.

The securing device further comprises a first strip having a first end and an opposing second end, and two lateral edges. The first strip is substantially flexible and elastic, and is attached to the first connector at the first end.

A plurality of cords or cord loops can be secured by wrapping the securing device around the cords or cord loops and then inserting a portion of the first strip into the central opening of the first connector via the access notch. The first strip is retained within the central opening by the opposing teeth.

In order to further promote retention of the first strip within the central opening, the first strip can be provided with a tapered central portion, ridges on the lateral edges of the strip or a knob-like structure at the second end.

In another preferred embodiment, the securing device comprises, in addition to the a first connector and a first strip as described above, a second connector with a second central opening and second access notch similar to the first connector. The second connector is attached to the second end of the first strip.

In addition to securing together a plurality of cords and to securing together a plurality of loops of one or more cords, this embodiment can also be used for securing together a first plug attached to a first cord with a second plug attached to a second cord. Two plugs can be secured together by inserting the first cord into the first central opening via the first access notch and then inserting the second cord into the second central opening via the second access notch. In so doing, the first strip is stretched thereby imparting inward axial tension on the plugs securing them together against the application of excess outward axial tension. The cords attached to the plugs are retained within their respective connectors by the opposing teeth.

In another preferred embodiment, the securing device comprises a first connector, a first strip and a second connector as described immediately above. In addition, it comprises a second strip having a first end and a second end, which is substantially flexible and elastic like the first strip. The device also comprises a third connector, similar to the first and second connector, having a third central opening and third access notch. The second connector is attached to the first end of the second strip. The third connector is attached to the second end of the second strip.

In addition to securing together a plurality of cords and to securing together a plurality of loops of one or more cords, this embodiment of the present invention can be used for securing together a first plug attached to a first cord with a second plug attached to a second cord. A first plug attached to a first cord can be secured to a second plug attached to a second cord by inserting the first cord into the first central opening via the first access notch. Next, the second cord is inserted into the second opening via the second access notch thereby stretching the first strip. The first cord is then inserted into the third central opening via the third access notch, thereby stretching the second strip. The stretched first and second strip impart inward axial tension on the plugs preventing separation upon the application of excess outward axial tension. The cords attached to the plugs are retained within their respective connectors by the opposing teeth.

DRAWINGS

These and other features, aspects and advantages of the present invention will become better understood with regard to the following description, appended claims, and the accompanying drawings where:

Figure 5:
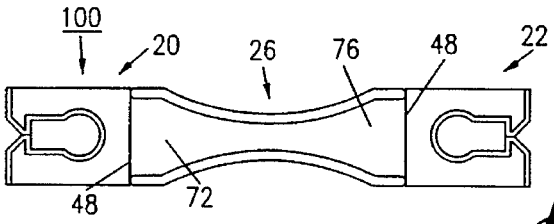
Figure 6:
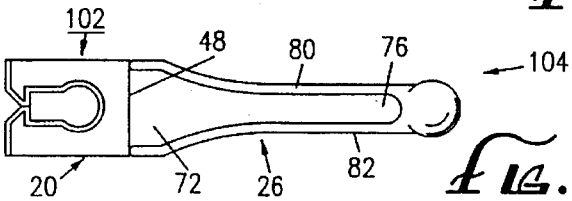

FIG. 5 is a top plan view of a second device having features of the invention, the device being useful for securing together a first plug attached to a first cord with a second plug attached to a second cord according to another embodiment of the present invention; and FIG. 6 is a top plan view of a third device having features of the invention, the device being useful for securing together a plurality of cords and for securing together a plurality of loops of one or more cords according to one second embodiment of the present invention.

Figure 7:
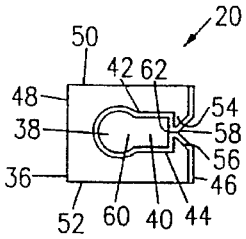

FIG. 7 is a top plan view of a connector used in the various embodiments of the present invention.

DESCRIPTION

Figure 1:
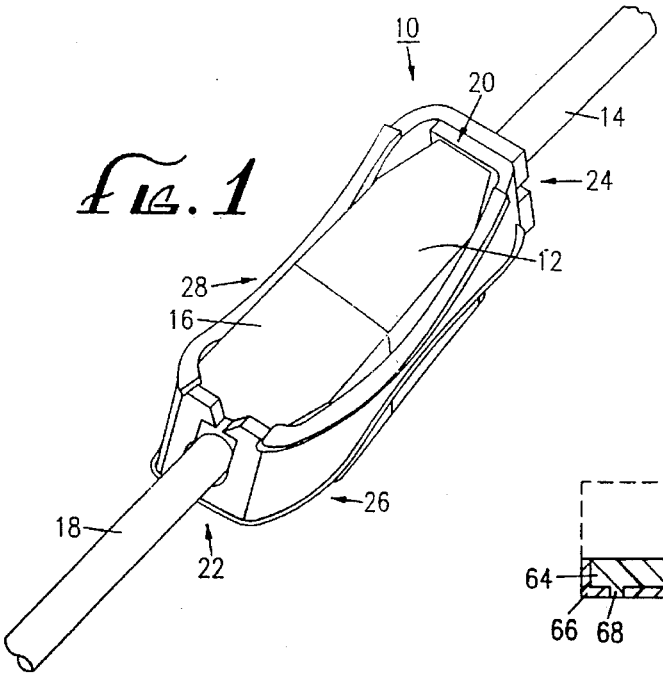
FIG. 1 is a perspective environmental view of a first device having features of the invention, the device being useful for securing together a first plug attached to a first cord with a second plug attached to a second cord.
Figure 2:
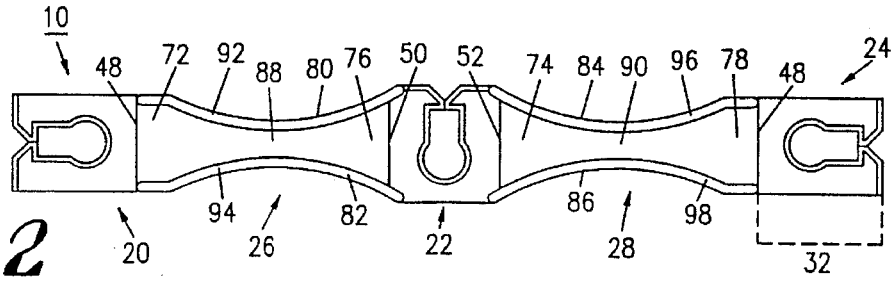
FIG. 2 is a top plan view of the device shown in FIG. 1.
Figure 3:
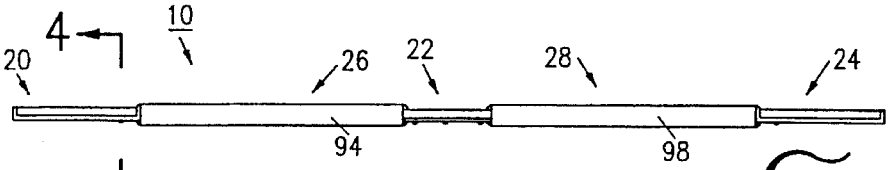
FIG. 3 is a side elevational view of the device shown in FIG. 1 and FIG. 2.

Referring now to FIGS. 1–3, there are illustrated a perspective environmental view, a top plan view and a side elevational view, respectively, of the device 10 for securing together a first plug 12 attached to a first cord 14 with the second plug 16 attached to a second cord 18 according to one embodiment of the present invention. The device 10 comprises a first connector 20, a second connector 22, a third connector 24, a first strip 26 and a second strip 28.

Referring now to FIG. 7, there is illustrated a top plan view of the first connector 20. Other connectors used in the various embodiments of the invention, such as the second connector 22 and third connector 24, have substantially the same elements except as noted herein. Therefore, similar elements between connectors will be noted by the same numbers herein.

As can be seen in FIGS. 1–7, the first connector 20 is substantially disc-shaped with respect to a reference plane such that its height 30, perpendicular to the reference plane, is substantially less than its length 32 or width 34 within the reference plane.

When viewed from the top, as shown in FIG. 7, the external edges 36 of the first connector 20 can take on a substantially rectangular appearance. However, many other shapes are also suitable for the intended uses described herein. For example, the first connector 20 can take on a substantially round, oval, square, irregular or other shape.

The first connector 20 comprises a central opening 38. The central opening 38 has a central opening cross-sectional area. For one method of using the present invention, a cord having a cord cross-sectional area perpendicular to its longitudinal axis is inserted into the central opening 38. Because most cords have substantially circular cross-sections, it is preferred that the central opening 38, also be substantially circular in cross-section with respect to the reference plane in order to better accommodate a cord.

The central opening cross-sectional area can be smaller than the cross-sectional area of the cord to be inserted therein, the same as the cross-sectional area of the cord to be inserted therein or larger than the cross-sectional area of the cord to be inserted therein. When the central opening cross-sectional area is smaller than the cross-sectional area of the cord to be inserted therein, the cord can still be inserted into the central opening 38 by slightly flexing the first connector 20 out of the reference plane. This flexion changes a substantially round central opening 38, with respect to the reference plane, into a substantially oval central opening 38, with respect to the reference plane, where the oval central opening cross-sectional area is larger than the round central opening cross-sectional area. When the force causing the first connector 20 to flex ceases, the central opening 38 tends to return to its original dimensions with respect to the reference plane, impinging the cord and thereby advantageously gripping the cord securely.

As will be appreciated by one with skill in the art, having a central opening 38 with a cross-sectional area larger than the cross-sectional area of the cord to be inserted therein permits greater ease of insertion of the cord into each central opening 38. Further, utilizing a central opening 38 with a relatively large cross-sectional area advantageously permits the connector to be used with cords having a greater variety of cross-sectional areas than does a central opening having a smaller cross-sectional area.

In addition to a central opening 38, the first connector 20 comprises an access notch 40 defined by two opposing sides 42 and 44. The access notch 40 serves to link the reference plane external to the first connector 20 with the central opening 38. The access notch 40 divides the first connector 20 into an access notch end 46, an end opposing the access notch 48 and two sides adjacent the access notch end 50 and 52.

The access notch 40 comprises at least one tooth 54 formed by one of the opposing access notch sides 42 and 44, and preferably two opposing teeth 54 and 56, one tooth formed by each of the opposing access notch sides 42 and 44. The tooth or teeth 42 and 44 serve to divide the access notch 40 into an outer space 58 and an inner space 60, where the outer space 58 directly communicates with the reference plane external to the first connector 20 and the inner space 60 directly communicate with the central opening 38.

The outer space 58 and the inner space 60 can take on any of a variety of shapes, which are determined by the shape of the access notch teeth 54 and 56, the central opening 38 and the outer edges 36 of the first connector 20. In a preferred embodiment, shown in FIG. 7, the access notch 40 comprises a triangular-shaped outer space 58 and a rectangular-shaped inner space 60 formed by opposing teeth 54 and 56, which closely approximate at a point 62 when the first connector 20 is not being flexed.

While each access notch 40 can be any of a variety of shapes, the triangular-shaped outer space 58, and rectangle-shaped inner space 60 combination shown in FIG. 7 is particularly preferred because the triangular-shaped outer space 58 helps to guide a cord or other member into the central opening 38 and the rectangle-shaped inner space 60 serves to isolate the opposing teeth 54 and 56 from the cord or other member thereby tending to prevent tension on the cord from flexing the opposing teeth 54 and 56 out of the reference plane. However, as will be appreciated by one with skill in the art with reference to the disclosure herein, each access notch 40 can be any suitable shape, including shapes which lack either or both of the triangular-shaped outer space 58 and the rectangular-shaped first inner space 60. Further, the access notch 40 can comprise an outer space serving the same function as the triangular-shaped outer space 58 that has a non-triangular shape, or an inner space serving the same function as the rectangular-shaped inner space 60 but having a non-rectangular shape.

In a preferred embodiment, each connector 20, 22 and 24 is substantially inflexible and substantially nonelastic. As used herein, the terms "substantially inflexible", "substantially nonelastic" and similar phrases signify that the first connector 20 will tend not to stretch or to bend out of the reference plane when a force is applied to each connector 20, 22 and 24 through the cord or member inserted into its central opening 38. However, it is understood that each connector 20, 22 and 24 retains enough flexibility and/or elasticity such that the opposing teeth 54 and 56 can be separated sufficiently to allow the cord or member to pass through each access notch 40 into the central opening 38 when manual force is applied to the opposing teeth 54 and 56 perpendicular to the reference plane during insertion and removal of the cord or member into and out of each central opening 38.

Each connector 20, 22 and 24 can comprise any of a variety of materials suitable for the intended functions disclosed herein. In one preferred embodiment, each connector 20, 22 and 24 comprises material or materials that are nonconductive and resistant to water such that each connector 20, 22 and 24 will not tend to be damaged during its intended uses. Further, it is advantageous that each connector 20, 22 and 24 comprise material or materials that are resistant to industrial chemicals, such as solvents, to the extent that each connector 20, 22 and 24 would be used around such chemicals. In one embodiment, each connector 20, 22 and 24 comprises a substantially homogeneous material that is substantially inflexible and substantially nonelastic, such as nylon or plastic.

Figure 4:
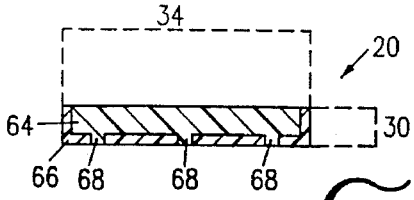
FIG. 4 is a cross-sectional view through one connector of the device shown in FIGS. 1 through 3, taken through line 4—4 and illustrating a connector having two adjoined layers.

Referring now to FIG. 4, there is illustrated another preferred embodiment showing a cross-sectional view of a two-layer connector 20 of the device shown in FIG. 3, taken through line 4—4. As shown, connector 20 comprises a first layer 64 and a second layer 66. When a connector, such as connector 20 comprises two layers, as shown in FIG. 4, at least one of the layers imparts substantial inflexibility and substantial nonelasticity to the connector 20.

While any of a variety of materials are suitable for the layer that imparts substantial inflexibility and substantial nonelasticity, as is understood by those with skill in the art, nylon or plastic is preferred because these materials can also exhibit the properties of nonconductivity and water resistance, are inexpensive, and are easy to manufacture into a variety of shapes.

The layers of a two-or-more-layered connector are joined such that they will not tend to separate during the intended uses of the device. The layers can be joined by any of a variety of methods that is suitable for the composition of the two layers. For example, they can be joined by fasteners or adhesives, or be chemically or thermally bonded.

In one preferred embodiment of the present invention, each connector 20, 22 and 24 comprises a nylon layer 64 bonded to a rubber layer 66 by a suitable adhesive. In a particularly preferred embodiment, the nylon layer 66 comprises a plurality of protrusions 68 which penetrate the rubber layer 66, thereby assisting in aligning the two layers 64 and 66 and making the two layers 64 and 66 integral.

In addition to comprising one or two layers, each connector 20, 22 and 24 can comprise three or more layers. The number of layers and the materials comprising the layers are limited only by the physical properties necessary for proper function by the connector 20, 22 and 24, as is understood by those with skill in the art. For example, the multiple layers can have layers of identical material interspersed with a layer of non-identical material, or can have three or more layers of non-identical material.

Further, for embodiments of the present invention comprising multiple connectors 20, 22 and 24, as is shown in FIGS. 1–3 and 5, one or more connectors 20, 22 and 24 can have a different number of layers than the other connector 20, 22 and 24 or connectors. Also, one or more of the connectors 20, 22 and 24 can have layers which comprise materials different than the materials comprising the layer or layers of the other connector or connectors. Even when the multiple connectors comprise the same number and composition of layers, the layers of one connector need not be oriented identically as the layers in the other connectors.

Each connector 20, 22 and 24 should be sufficiently thick to withstand the forces inherent in its uses as disclosed herein. In a preferred embodiment, each connector 20, 22 and 24 is between about 1/16 inch and 1/2 inch thick, and more particularly about 1/8 inch, depending on the material or materials it comprises. In another preferred embodiment, each connector 20, 22 and 24 comprises one layer of nylon and a second layer of rubber, having a joint thickness of about 1/8 inch.

Each connector 20, 22 and 24 has dimensions proportioned to fit standard plugs and cords, though it can be made in a variety of sizes commensurate with the variety of plugs and cords to which the device could be applied. In one preferred embodiment, each connector 20, 22 and 24 is approximately 1 inch long and about 3/4 inches wide.

Referring again to FIGS. 1–3, the device according to one embodiment of the present invention further comprises a first strip 26 and a second strip 28. Each strip comprises a first end 72 and 74, an opposing second end 76 and 78, and two lateral edges 80/82 and 84/86, respectively. The longitudinal axis of each strip lies between each first end 72/74 and second end 76/78.

In a preferred embodiment, each strip is substantially flexible and substantially elastic. As used herein, the terms "substantially flexible", "substantially elastic" and similar phrases signify that each strip will tend to stretch and to bend when a force is applied to the strip along its axis and that the strip will tend to return to its original shape when the forces ceases.

Each strip comprises materials that are substantially flexible and substantially elastic. These materials can be any of a variety of natural or synthetic substances, including woven synthetic materials, which have the necessary flexibility and elasticity. In a preferred embodiment, each strip comprise rubber. Also, in embodiments comprising more than one strip, it is preferred that all strips comprise identical material for ease of manufacture, though the strips can comprise different materials from one another.

Each strip can be any of a variety of shapes. In a preferred embodiment each strip is substantially rectangular. In another preferred embodiment, each strip is substantially rectangular but tapered centrally, 88 and 90 for the first strip and the second strip respectively, along its axis such that each strip has a narrower profile in the center when viewed from the top as illustrated in FIG. 2, or from the bottom, not illustrated. In another preferred embodiment, at least one of the lateral edges comprises a ridge 92, 94, 96 and 98.

Each strip should be sufficiently thick to withstand the forces inherent in its uses as disclosed herein. Preferably, each strip is between about 1/16 inch and ½ inch thick, at its thinnest place depending on the materials it comprises. In a particularly preferred embodiment, each strip comprises rubber about ⅛ inch thick.

Each strip has dimensions proportioned to fit standard plugs and cords, though it can be made in a variety of sizes commensurate with the variety of plugs and cords to which the device could be applied. In one preferred embodiment, each strip is approximately 2¼ inches long and about ¾ inches wide at the ends tapering to about ½ inch centrally.

FIGS. 1–3 illustrate the relationship between the connectors 20, 22 and 24 and strips 26 and 28 according to one preferred embodiment 10. The end of first connector opposing the first access notch 48 is attached to first end of the first strip 72. The second connector 22 is connected to the second end of the first strip 76 as well as the first end of the second strip 74 at alternate sides of the second connector adjacent to the second access notch 50/52. The end of the third connector opposite each access notch 48 is connected to the second end of the second strip 78.

Referring back to FIG. 1, there is illustrated one method of using the present invention for securing together a first plug 12 attached to a first cord 14 with a second plug 16 attached to a second cord 18. This is accomplished by inserting the first cord 14 into the central opening of the first connector 38 via the access notch of the first connector 40. Next, the second cord 18 is inserted into the second central opening of the second connector 38 via the access notch of the second connector 40, thereby stretching the first strip 26 in an axial direction. Finally, the first cord 14 is inserted into the central opening of the third connector 38 via the access notch of the third connector 40, thereby stretching the second strip 28 in an axial direction.

Stretching the first strip 26 and second strip 28 imparts inward axial tension on the plugs 12 and 16. This inward axial tension tends to counter outward axial tension which might accidentally separate the two plugs 12 and 16. The first cord 14 and second cord 18 are retained within the central openings of the first, second and third connectors 38 by the respective connectors' opposing teeth 54 and 56.

Referring now to FIG. 5, there is illustrated a top plan view of another embodiment of the invention 100. This embodiment can be used to secure together a first plug 12 attached to a first cord 14 with a second plug 16 attached to a second cord 18, not illustrated. As can be seen, the device 100 comprises a first connector 20, a second connector 22 and a first strip 26. The first connector 20, the second connector 22 and the first strip 26 all have the configuration and properties as described above. In this embodiment of the present invention 100, the end of the first connector opposite the first access notch 48 is attached to the first end of the first strip 72. Similarly, the end of the second connector opposite the second access notch 48 is attached to the second end of the first strip 76.

This embodiment of the present invention is used as follows. The first cord 14 attached to the first plug 12 is inserted into the central opening of the first connector 38 via the access notch of the first connector 40. The second cord 18 attached to the second plug 16 is then inserted into the central opening of the second connector 38 via the access notch of the second connector 40 which stretches the first strip 26. Stretching the first strip 26 imparts inward axial tension on the first plug 12 and second plug 16, thereby tending to prevent separation of the plugs upon application of excess outward axial tension. The cords attached to the plugs are retained within their respective connectors by the opposing teeth 54 and 56.

Referring now to FIG. 6, there is illustrated a top plan view of still another embodiment of the invention. This embodiment 102 can be used to secure together a plurality of cords and to secure together a plurality of loops of one or more cords, not illustrated. This embodiment 102 of the present invention comprises a first connector 20 and a first strip 26 having the characteristics and properties of the connectors and strips described above. The end of the first connector opposing the access notch 48 is attached to the first end of the first strip 72. The second end of the first strip 76 can be attached to a knob-like device 104, as is illustrated in FIG. 6, or can be attached to a device having another shape (including a connector, connector plus strip or two connectors with a strip therebetween).

The embodiment 102 illustrated in FIG. 6 secures together a plurality of cords or a plurality of loops of one or more cords by first wrapping the device around the cords or loops. Next, the first strip 26 is inserted into the central opening of the first connector 38 via the access notch of the first connector 40. This action approximates the cords or loops to one another. The first strip 26 is retained within the access notch of the first connector 38 by the opposing teeth 54 and 56. To assist in maintaining the first strip 26 within the first central opening 38, the first strip 26 can be provided with one or more of a tapered central portion, a ridge or ridges on the lateral edge or edges of the first strip 80 and 82, or a knob-like 104 or otherwise shaped apparatus attached to the second end of the first strip 26.

The devices described above for securing together a first plug 12 attached to a first cord 14 with a second plug 16 attached to a second cord 18 can also be used to secure together a plurality of cords and to secure together a plurality of loops of one or more cords. These latter two functions are accomplished by using the first connector 20 and first strip 26 portion of the devices in the manner described immediately above. Alternately, for a device comprising at least two connectors and two strips as disclosed herein, a plurality of cords or a plurality of loops of one or more cords can be secured together by wrapping the device around the cords or loops and then inserting the second or sequentially later strip (rather than the first strip 26) into the central opening of the first connector 38 via the access notch of the first connector 40. The second or sequentially later strip is retained within the access notch of the first connector 40 by the opposing teeth 54 and 56 of the first connector.

When not in use, it is preferred that all connectors 20, 22 and 24 and all strips 26 and 28 are substantially coplaner. This arrangement makes storage easier than for noncoplaner embodiments of the present invention.

Although the present invention has been described in considerable detail with reference to certain preferred embodiments thereof, other embodiments are possible. For example, embodiments with more than three connectors and more than two strips are feasible for simultaneously securing together more than one pair of plugs, more than one group of cords or loops, or at least one pair of plugs and one group of cords or loops. Therefore, the spirit and scope of the appended claims should not be limited to the description of the preferred embodiments contained herein.

I claim:

1. A securing device suitable for securing together a plurality of cords and for securing together a plurality of loops of one or more cords, comprising:

(a) a disk-shaped first connector disposed within a reference plane, the first connector comprising two adjoined layers and being substantially inflexible and substantially nonelastic, the connector defining:

(i) a central opening; and (ii) an access notch capable of allowing a member disposed perpendicular to the reference plane to be inserted into the central opening;

(b) a first strip attached to the first connector, the first strip being substantially flexible and elastic; and whereby a plurality of cords or cord loops can be secured by wrapping the securing device around the plurality of cords or cord loops and by thereafter attaching the first connector to the first strip by inserting a portion of the first strip into the central opening via the access notch, the first strip being retained within the first connector by the opposing teeth.

2. The securing device of claim 1, wherein the first strip comprises two lateral edges, each edge having a ridge thereon.

3. The securing device of claim 1, wherein the first strip is tapered centrally.

4. The securing device of claim 1, wherein the first strip has a thickness between about 1/16 inch and about ½ inch.

5. The securing device of claim 1, wherein the access notch includes a pair of opposing teeth disposed in close proximity within the reference plane.

6. A securing device suitable for securing together a first plug attached to a first cord with a second plug attached to a second cord, wherein the first cord and the second cord can be the same or different cords, comprising:

(a) a first strip having a first end and a second end, wherein the strip is substantially flexible and elastic; and (b) a disk-shaped first connector attached to the first end of the strip and disposed within a first reference plane, the first connector being substantially inflexible and substantially nonelastic, the first connector defining:

(i) a first central opening; and (ii) a first access notch which allows a member disposed perpendicular to the reference plane to be inserted into the first central opening;

(c) a disk-shaped second connector attached to the second end of the strip and disposed within a second reference plane, the second connector being substantially inflexible and substantially nonelastic, the second connector defining:

(i) a second central opening; and (ii) a second access notch which allows a member disposed perpendicular to the second reference plane to be inserted into the second central opening;

wherein at least one of the first connector and the second connector comprises two adjoined layers; and whereby the first and second plugs can be secured together by inserting the first cord into the first central opening via the first access notch, and by inserting the second cord into the second central opening via the second access notch, thereby placing inward axial tension on the plugs securing them together, the cords attached to the plugs being retained within the respective connectors by the opposing teeth.

7. The securing device of claim 6, wherein the first strip comprises two lateral edges, each edge having a ridge thereon.

8. The securing device of claim 6, wherein at least one of the first strip is tapered centrally.

9. The securing device of claim 6 wherein the first strip has a thickness between about 1/16 inch and about ½ inch.

10. The securing device of claim 6, wherein the first strip has a thickness between about 1/16 inch and about ½ inch.

11. The securing device of claim 6, wherein at least one of the access notches includes a pair of opposing teeth disposed in close proximity within the reference plane.

12. A securing device suitable for securing together a first plug attached to a first cord with a second plug attached to a second cord, wherein the first cord and the second cord can be the same or different cords, comprising:

(a) a first strip having a first end and a second end, wherein the first strip is substantially flexible and elastic; and (b) a second strip having a first end and a second end, wherein the second strip is substantially flexible and elastic; and (c) a disk-shaped first connector attached to the first end of the first strip and disposed within a first reference plane, the first connector being substantially inflexible and substantially nonelastic, the first connector defining:

(i) a first central opening; and (ii) a first access notch which allows a member disposed perpendicular to the reference plane to be inserted into the first central opening, the first access notch including a first pair of opposing teeth disposed in close proximity within the reference plane;

(d) a disk-shaped second connector attached to the second end of the first strip and the first end of the second strip and disposed within a second reference plane, the second connector being substantially inflexible and substantially nonelastic, the second connector defining:

(i) a second central opening; and (ii) a second access notch which allows a member disposed perpendicular to the second reference plane to be inserted into the second central opening, the second access notch including a second pair of opposing teeth disposed in close proximity within the second reference plane;

(e) a disk-shaped third connector attached to the second end of the second strip and disposed within a third reference plane, the third connector being substantially inflexible and substantially nonelastic, the third connector defining:

(i) a third central opening; and (ii) a third access notch which allows a member disposed perpendicular to the third reference plane to be inserted into the third central opening, the third access notch including a third pair of opposing teeth disposed in close proximity within the third reference plane;

whereby the first and second plugs can be secured together by inserting the first cord into the first central opening via the first access notch, inserting the second cord into the second central opening via the second access notch, and inserting the first cord into the third central opening via the third access notch, thereby placing inward axial tension on the plugs securing them together, the cords attached to the plugs being retained within the respective connectors by the opposing teeth.

13. The securing device of claim 12, wherein at least one of the first strip and the second strip comprises rubber.

14. The securing device of claim 12, wherein at least one of the first strip and the second strip comprises two lateral edges, each edge having a ridge thereon.

15. The securing device of claim 12, wherein at least one of the first strip and the second strip is tapered centrally.

16. The securing device of claim 12, wherein at least one of the first strip and the second strip has a thickness between about 1/16 inch and about ½ inch.

17. The securing device of claim 12, wherein the first and second strips, and the first, second and third connectors are water-resistant and nonconductive.

18. The securing device of claim 12, wherein the central opening of the first, second and third connectors have first opening, second opening and third opening cross-sectional areas respectfully, and the cord attached to the first plug and the cord attached to the second plug have first cord and second cord cross-sectional areas respectfully, and wherein the first opening and third opening cross-sectional areas are smaller than the first cord cross-sectional area prior to insertion of the first cord into the first central opening, and wherein the second opening cross-sectional area is smaller than the second cord cross-sectional area prior to insertion of the second cord into the second central opening.

19. The securing device of claim 12, wherein at least one of the first connector, the second connector and the third connector comprises two adjoined layers.

20. The securing device of claim 19, wherein one of the adjoined layers comprises nylon.

21. A securing device suitable for securing together a plurality of cords and for securing together a plurality of loops of one or more cords, comprising:

(a) a disk-shaped first connector disposed within a reference plane, the first connector comprises two adjoined layers and being substantially inflexible and substantially nonelastic, the connector defining:

(i) a central opening; and (ii) an access notch capable of allowing a member disposed perpendicular to the reference plane to be inserted into the central opening;

(b) a first strip attached to the first connector, the first strip being substantially flexible and elastic and comprising two lateral edges, each edge having a ridge thereon; and whereby a plurality of cords or cord loops can be secured by wrapping the securing device around the plurality of cords or cord loops and by thereafter attaching the first connector to the first strip by inserting a portion of the first strip into the central opening via the access notch, the first strip being retained within the first connector by the opposing teeth,

22. A securing device suitable for securing together a first plug attached to a first cord with a second plug attached to a second cord, wherein the first cord and the second cord can be the same or different cords, comprising:

(a) a first strip having a first end and a second end, wherein the strip is substantially flexible and elastic, and comprises two lateral edges, each edge having a ridge thereon; and (b) a disk-shaped first connector attached to the first end of the strip and disposed within a first reference plane, the first connector being substantially inflexible and substantially nonelastic, the first connector defining:

(i) a first central opening; and (ii) a first access notch which allows a member disposed perpendicular to the reference plane to be inserted into the first central opening;

(c) a disk-shaped second connector attached to the second end of the strip and disposed within a second reference plane, the second connector being substantially inflexible and substantially nonelastic, the second connector defining:

(i) a second central opening; and (ii) a second access notch which allows a member disposed perpendicular to the second reference plane to be inserted into the second central opening;

whereby the first and second plugs can be secured together by inserting the first cord into the first central opening via the first access notch, and by inserting the second cord into the second central opening via the second access notch, thereby placing inward axial tension on the plugs securing them together, the cords attached to the plugs being retained within the respective connectors by the opposing teeth.

23. The securing device of claim 22, wherein at least one of the first connector and the second connector comprises two adjoined layers.

24. The securing device of claim 22, wherein at least one of the access notches includes a pair of opposing teeth disposed in close proximity within the reference plane.

* * * * *